US006989078B1

(12) United States Patent
Bokström et al.

(10) Patent No.: US 6,989,078 B1
(45) Date of Patent: Jan. 24, 2006

(54) SYSTEM FOR CONVEYING SHREDDED PULP TO AN OZONE REACTOR

(75) Inventors: Monica Bokström, Kovland (SE); Per Åström, Kovland (SE)

(73) Assignee: Valmet Fibertech AB, (SE)

( * ) Notice: Subject to any disclaimer, the term of this patent is extended or adjusted under 35 U.S.C. 154(b) by 0 days.

(21) Appl. No.: 10/009,052

(22) PCT Filed: May 24, 2000

(86) PCT No.: PCT/SE00/01052

§ 371 (c)(1),
(2), (4) Date: Dec. 6, 2001

(87) PCT Pub. No.: WO00/77296

PCT Pub. Date: Dec. 21, 2000

(30) Foreign Application Priority Data

Jun. 10, 1999 (SE) ..... 9902178

(51) Int. Cl.
*D21C 1/16* (2006.01)
*D21C 7/06* (2006.01)
*D21C 9/53* (2006.01)

(52) U.S. Cl. ..... 162/236; 162/252; 162/254; 162/261; 162/263

(58) Field of Classification Search ..... 162/49, 162/61, 62, 263, 238, 65, 246, 52, 18, 51, 162/243, 181.2, 182, 183, 9, 25, 90, 242, 162/252, 254, 261
See application file for complete search history.

(56) References Cited

U.S. PATENT DOCUMENTS 4,278,496 A 7/1981 Fritzvold
5,942,088 A * 8/1999 Shackford et al. ..... 299/5.6

FOREIGN PATENT DOCUMENTS

EP 0 492 040 A1 * 7/1992 ..... 162/65
WO WO-965365 A1 2/1996
WO 9705324 * 2/1997
WO 9605365 * 2/1999

* cited by examiner

*Primary Examiner*—Dionne A. Walls
*Assistant Examiner*—Carlos Lopez
(74) *Attorney, Agent, or Firm*—Lerner, David, Littenberg, Krumholz & Mentlik, LLP

(57) ABSTRACT

Methods and systems for the treatment of pulp are provided. The methods include dewatering pulp to a fiber concentration of at least 20%, shredding the dewatered pulp in a closed pulp shredding vessel, transporting the shredded pulp without compression continuously out of the pulp shredding vessel through an outlet pipe which is kept completely filled with passing pulp, directly transporting the shredded pulp to a reaction vessel through a gas-tight conduit gas sealed from the surroundings and communicating with the outlet pipe and the reaction vessel, bleaching the shredded pulp in the reaction vessel with ozone gas, and regulating the gas pressure in the pulp shredding vessel and in the reaction vessel so that ozone gas is prevented from leaking upstream through the outlet pipe.

6 Claims, 1 Drawing Sheet

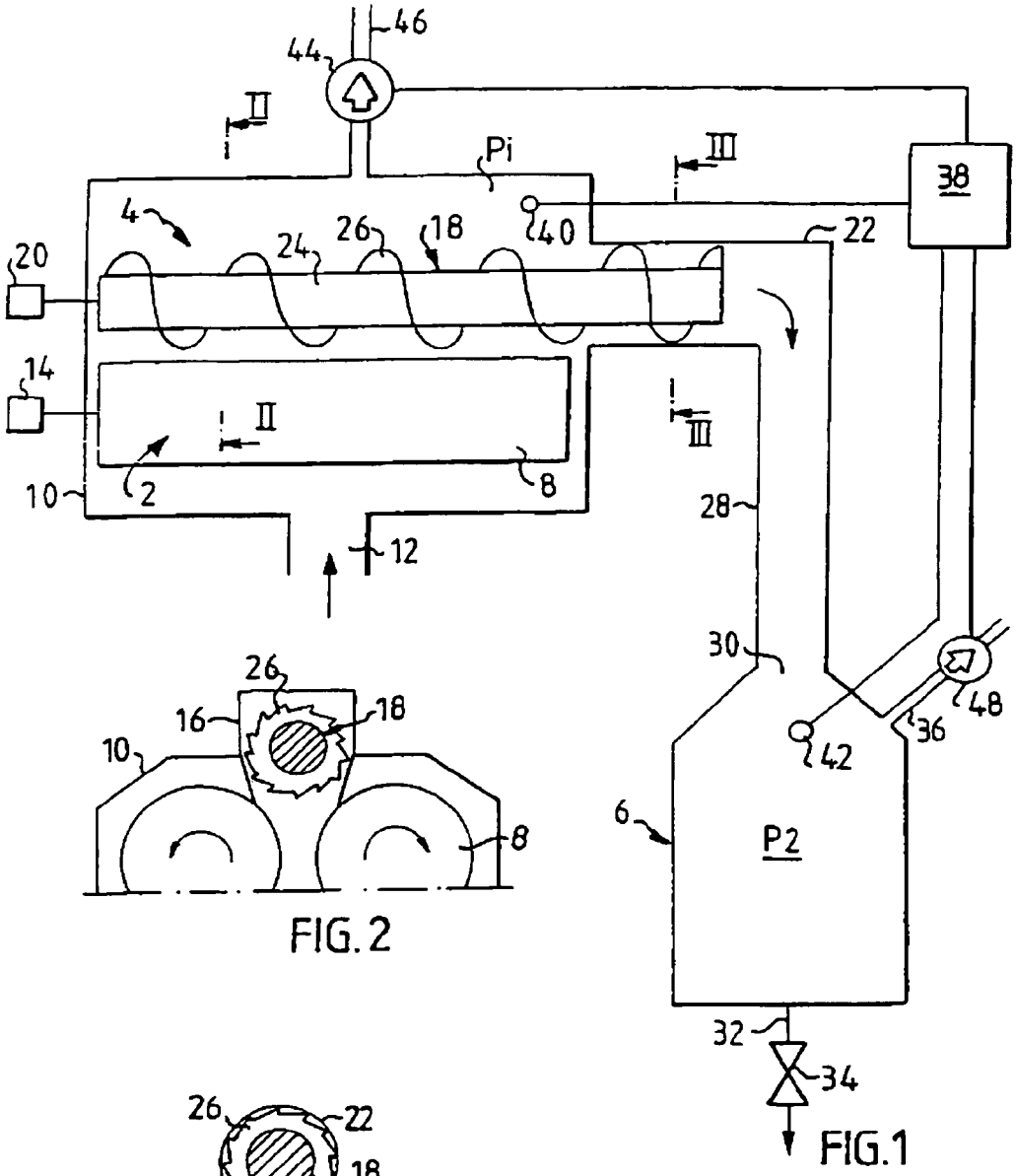
FIG.1
FIG.2
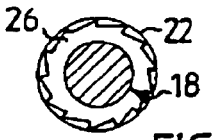
FIG.3

SYSTEM FOR CONVEYING SHREDDED PULP TO AN OZONE REACTOR

FIELD OF THE INVENTION

The present invention relates to a method of treatment of pulp, which in a dewatering step is dewatered to a fiber concentration of at least 20% and which in a later bleaching step is bleached in an reactor vessel through reaction with ozone gas. More particularly, the present invention also relates to a system for treatment of pulp, comprising a dewatering device for dewatering the pulp to a fiber concentration of at least 20%, and a reactor vessel for bleaching the dewatered pulp through reaction with ozone gas.

BACKGROUND OF THE INVENTION

In traditional systems for ozone bleaching of pulp at a high pulp concentration the pulp has to undergo a process comprising a number of preparatory treatment steps before the pulp can finally be bleached with ozone gas in the reactor vessel. Thus, the pulp is dewatered in an initial dewatering step in the dewatering device, usually in the form of a twin roll press. The dewatered pulp is shredded in a subsequent pulp shredding step in a shredder. The dewatered and shredded pulp is then transported in a transporting step, usually by a plug screw, from the shredder to a fluffer, in which the pulp is fluffed in a fluffing step. Once the pulp has undergone these preparatory steps it can be bleached in the reactor vessel.

The function of the plug screw is to compress the shredded pulp to a plug forming a gas lock preventing ozone gas from leaking from the reaction vessel upstream in the system to the surroundings. The function of the fluffer is to fluff up the compressed pulp leaving the pulp screw, so that the pulp gets a large specific surface, which facilitates the reaction of the ozone gas with the lignin of the pulp. Thus, the pulp entering the reactor vessel has to be fluffed, in order to obtain a high ozone utilization and a good bleaching selectivity.

International Application No. WO 06/05365 A1 shows a known pulp treatment system comprising a pulp plug forming plugscrew for transportation of dewatered and shredded pulp to a fluffer, and a reaction vessel containing pulp bleaching gas.

Thus, the above described traditional pulp treatment system for bleaching pulp with ozone gas is relatively extensive and consequently expensive, which is a disadvantage. In addition, with several treatment steps in the process the entire system will be more sensitive to disturbances in each single part of the process. Therefore it would be of advantage if one or more treatment steps could be eliminated.

One object of the present invention is to provide a new method for treating pulp, which is bleached through reaction with ozone gas, which method is simpler and more reliable than traditional methods and results in an efficient ozone utilization for the bleaching of the pulp.

SUMMARY OF THE INVENTION

In accordance with the present invention, this and other objects have now been realized by the invention of a method of treating pulp, comprising dewatering the pulp to a fiber concentration of at least 20%, shredding the dewatered pulp in a closed pulp shredding vessel, transporting the shredded pulp without compression continuously out of the pulp shredding vessel through an outlet pipe therefrom, so that the outlet pipe is kept completely filled with passing pulp, directly transporting the shredded pulp from the outlet pipe of the pulp shredding vessel to a reaction vessel through a gas-tight conduit, which is gas sealed from the surroundings, the interior of the conduit communicating with the interior of the outlet pipe and with the interior of the reaction vessel, bleaching the shredded pulp in the reaction vessel through reaction with ozone gas, and regulating the gas pressure in the pulp shredding vessel and the gas pressure in the reaction vessel so that ozone gas is prevented from leaking upstream through the outlet pipe. In a preferred embodiment, the method further comprises keeping the gas pressure in the pulp shredding vessel higher than the gas pressure in the reaction vessel. Preferably, the method further includes regulating the pressure difference between the gas pressure in the pulp shredding vessel and the gas pressure in the reaction vessel towards a predetermined value. Most preferably, the method further includes keeping the gas pressures in the pulp shredding vessel and the reaction vessel below the surrounding atmospheric pressure.

In accordance with one embodiment of the method of the present invention, the method further comprises transporting the shredded pulp by gravity in the gas-tight conduit.

In accordance with another embodiment of the method of the present invention, the method further comprises shredding the pulp in the pulp shredding vessel by a transport screw with at least one toothed transport thread, and transporting the shredded pulp by the transport screw through the outlet pipe of the pulp shredding vessel.

In accordance with the present invention, a system has also been provided for the treatment of pulp comprising a dewatering device for dewatering the pulp to a fiber concentration of at least 20%, a pulp shredding device for shredding the dewatered pulp, the pulp shredding device including a closed pulp shredding vessel, an outlet pipe from the pulp shredding vessel, and a transport means adapted to continuously transport the shredded pulp without compressing the pulp out of the pulp shredding vessel through the outlet pipe, so that the outlet pipe is kept filled with passing pulp, a reaction vessel for bleaching the shredded pulp through reaction with ozone gas, a conduit gas sealed from the surroundings and connecting the outlet pipe of the pulp shredding vessel gas-tightly to the reaction vessel, so that the interior of the outlet pipe directly communicates with the interior of the reaction vessel through the interior of the conduit, and a pressure regulation device for regulating the gas pressure in the pulp shredding vessel and the gas pressure in the reaction vessel so that ozone gas is prevented from leaking upstream through the outlet pipe. Preferably, the pressure regulation device is adapted to maintain the gas pressure in the pulp shredding vessel higher than the gas pressure in the reaction vessel. In a preferred embodiment, the transport means comprises a transport screw extending in the pulp shredding vessel and provided with at least one toothed transport thread for shredding the pulp. In a preferred embodiment, the transport screw also extends in the outlet pipe of the pulp shredding vessel.

In accordance with one embodiment of the system of the present invention, the pressure regulation device regulates the pressure difference between the gas pressure in the pulp shredding vessel and the gas pressure in the reaction vessel towards a predetermined value. In a preferred embodiment, the pressure regulation device comprises a first fan with controllable capacity arranged in a gas outlet in the pulp shredding vessel for evacuation of gas therefrom, a second fan with controllable capacity arranged in a gas outlet in the reaction vessel for evacuation of gas therefrom, a first pressure sensor for sensing the gas pressure in the pulp shredding vessel, a second pressure sensor for sensing the gas pressure in the reaction vessel, and a regulation unit which in response to the first and second pressure sensors, respectively, regulates the capacity of the first and second fans, respectively.

The objects of the present invention are achieved by a method in which, after the dewatering step and before the bleaching step, the pulp is shredded in a closed pulp shredding vessel, the shredded pulp is transported without compression continuously out of the pulp shredding vessel through an outlet pipe therefrom, so that the outlet pipe is kept filled with passing pulp, from the outlet pipe of the pulp shredding vessel the shredded pulp is directly transported to the reaction vessel through a conduit which is gas sealed from the surroundings, the interior of the conduit communicating with the interior of the outlet pipe and with the interior of the reactor vessel, and the gas pressure in the pulp shredding vessel is kept higher than the gas pressure in the reactor vessel.

It has been proved that the combination of the two measures—(1) to keep the outlet pipe filled with passing shredded non-compressed pulp, and—(2) to maintain the gas pressure in the pulp shredding vessel higher than that of the reactor vessel, is sufficient to prevent ozone gas from leaking upstream out to the surroundings. In this manner, neither a plug screw nor a fluffer is needed, which makes the new method according to the present invention particularly simple and reliable.

Advantageously, the pressure difference between the gas pressure in the pulp shredding vessel and the gas pressure in the reactor vessel is regulated towards a predetermined value, wherein the gas pressures in the pulp shredding vessel and the reactor vessel are suitably kept under the surrounding atmospheric pressure.

Preferably, the shredded pulp is transported in the gas-tight conduit by the aid of gravity without need for any mechanical transportation means.

In the pulp shredding vessel the pulp is advantageously shredded by a transport screw with at least one toothed thread, wherein the transport screw also provides the transportation of the shredded pulp through the outlet pipe of the pulp shredding vessel.

A further object of the present invention is to provide a new system for treating pulp, which is bleached through reaction with ozone gas, which system is simpler than the above described traditional systems and eliminates the above mentioned disadvantages and problems thereof.

This object is obtained by a system in which there is provided a pulp shredding device for shredding the dewatered pulp, which pulp shredding device comprises a closed pulp shredding vessel, an outlet pipe from the pulp shredding vessel, and a transport means for continuous transport of the shredded pulp without compressing the pulp out of the pulp shredding vessel through the outlet pipe, so that the latter is kept filled with passing pulp, a conduit which is gas sealed from the surroundings and which connects the outlet pipe of the pulp shredding vessel gas tightly to the reaction vessel, so that the interior of the outlet pipe directly communicates with the reaction vessel through the interior of the conduit, and a pressure regulation device for maintaining a gas pressure in the pulp shredding vessel which is higher than that of the reaction vessel.

According to a preferred embodiment of the system according to the present invention the transport means comprises a transport screw extending in the pulp shredding vessel, preferably also in the outlet pipe of the pulp shredding vessel, and which is provided with at least one toothed thread for shredding the pulp.

Advantageously the pressure regulation device regulates the pressure difference between the gas pressure in the pulp shredding vessel and the gas pressure in the reactor vessel toward a predetermined value.

Preferably the pressure regulation device comprises a first fan with a controllable capacity arranged in a gas outlet in the pulp shredding vessel for evacuation of gas therefrom, a second fan with controllable capacity arranged in a gas outlet in the reactor vessel for evacuation of gas therefrom, a first pressure sensor for sensing the gas pressure in the pulp shredding vessel, a second pressure sensor for sensing a gas pressure in the reaction vessel, and a regulation unit which in response to the first and second pressure sensors, respectively, regulates the capacity of the first and second fans, respectively.

BRIEF DESCRIPTION OF THE DRAWINGS

The present invention may be more fully appreciated with reference to the following detailed description which, in turn, refers to the accompanying drawings, in which:

FIG. 1 is a side, elevational, partially schematic representation of a system according to the present invention;

FIG. 2 is a side, elevational, partially sectional view of a portion of the system shown in FIG. 1 taken along line II-II thereof; and FIG. 3 is a side, elevational, partially sectional view of a portion of the system shown in FIG. 1 taken along line III-III thereof.

DETAILED DESCRIPTION

The drawings show a system for treatment of pulp comprising a dewatering device 2, a pulp shredding device 4 and a reaction vessel 6 for bleaching of pulp through reaction with ozone gas. The dewatering device 2 comprises two pressure rolls 8, which are arranged to counter rotate in a housing 10, and an inlet 12 for pulp to be dewatered in the lower part of the housing 10. A motor 14 provides for the rotation of the pressure rolls 8. An elongated closed pulp shredding vessel 16 extends along the pressure rolls 8 above these. In the pulp shredding vessel 16 a transport screw 18 extends in parallel with the pressure rolls 8. Another motor 20 is adapted to rotate the transport screw 18. The pulp shredding vessel 16 has a lower elongated inlet for pulp to be dewatered by the pressure rolls 8 (see FIG. 2) and an outlet pipe 22, through which the transport screw 18 extends in part, for dewatered and shredded pulp.

The transport screw 18 has a core 24 with a constant diameter and a toothed transport thread 26 with a constant pitch and diameter. The portion of the transport thread 26 extending in the outlet pipe 22 may alternatively be non-toothed. The interior of the outlet pipe 22 also has a constant diameter which is somewhat larger than the diameter of the transport thread 26. Alternatively the transport screw 18 may have more than one transport thread 26.

A vertical gas-tight conduit 28 connects the outlet pipe 22 gas-tightly to an upper inlet 30 in the reaction vessel 6, so that the interior of the outlet pipe 22 directly communicates with the interior of the reaction vessel 6 through the interior of the conduit 28. The reaction vessel 6 has a lower outlet conduit 32 provided with a valve 34, for discharge of bleached pulp, and an upper outlet conduit 36 for evacuation of gas. There is also a device, not shown, for supplying ozone gas to the interior of the reaction vessel 6.

A regulation unit 38 is by means of signal lines connected to a pressure sensor 40 for sensing the gas pressure P1 in the pulp shredding vessel 16 and to a pressure sensor 42 for sensing the gas pressure P2 in the reaction vessel 6. The regulation unit 38 is by means of further signal lines also connected to a fan 44 with a controllable capacity located in an upper outlet conduit 46 from the pulp shredding vessel 16, and to another fan 48 likewise with a controllable capacity located in the upper outlet conduit 36 of the reaction vessel 6.

During operation a pulp suspension is pumped through the inlet 12 of the dewatering device 2 to the pressure rolls 8, which are counter rotated by the motor 14, the direction of rotation of the pressure rolls being indicated by arrows in FIG. 3, so that the pulp is pulled between the pressure rolls 8 while being dewatered up to the inlet of the pulp shredding vessel 16. When entering the inlet of the pulp shredding vessel 16 the dewatered pulp has a fiber concentration of 20-45%. In the pulp shredding vessel 16 the pulp is shredded by the toothed transport thread 26 of the transport screw 18, which is rotated by the motor 20. Depending on the desired result the toothing of the transport thread 26 may be shaped so that a relatively coarse or fine shredding of the pulp is obtained. In addition the transport screw 18 transports shredded pulp through the outlet pipe 22 without compressing the pulp. From the outlet pipe 22 the shredded pulp drops through the vertical conduit 28 to the reaction vessel 6, where the pulp is bleached through reaction with ozone gas. Finally the bleached pulp is discharged from the reactor vessel 6 through the lower outlet conduit 32.

The regulation unit 38 controls the capacity of the fans 44 and 48, for instance by speed control, in response to the pressure sensors 40 and 42, so that the gas pressure P1 in the pulp shredding vessel 16 is kept higher than the gas pressure P2 in the reaction vessel 6. At least the gas pressure P2 is kept by the regulation unit 38 below the surrounding atmospheric pressure. Suitably the regulation unit 38 keeps the gas pressure P1 in the range of 0–14 kPa (overpressure) and the gas pressure P2 in the range 1–15 kPa (overpressure) at the same time as the regulation unit 38 regulates the pressure difference between the gas pressures P1 and P2 towards a predetermined value, which is chosen in the range of about 0.5 to 1.5 kPa.

By the fact that the shredded and fluffed pulp trans- ported by the transport screw 18 through the outlet pipe 22 completely fills the latter at the same time as the gas pressure is decreased from the interior of the pulp shredding vessel to the interior reactor vessel, ozone gas is efficiently prevented from passing upstream in the system to the surroundings.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A system for treatment of pulp, comprising:

a dewatering device for dewatering said pulp to a fiber concentration of at least 20%, a pulp shredding device for shredding said dewatered pulp, said pulp shredding device including a closed pulp shredding vessel, an outlet pipe from said pulp shredding vessel, and a transport means adapted to continuously transport said shredded pulp without compressing the pulp out of said pulp shredding vessel through said outlet pipe, so that said outlet pipe is kept filled with passing pulp, a reaction vessel for bleaching said shredded pulp through reaction with ozone gas, a conduit gas sealed from the surroundings and connecting said outlet pipe of said pulp shredding vessel gas-tightly to said reaction vessel, so that the interior of said outlet pipe directly communicates with the interior of said reaction vessel through the interior of said conduit, and a pressure regulation device for regulating the gas pressure in said pulp shredding vessel and the gas pressure in said reaction vessel so that ozone gas is prevented from leaking upstream through said outlet pipe, said pressure regulation device comprising a first fan with controllable capacity arranged in a gas outlet in said pulp shredding vessel for evacuation of gas therefrom, a second fan with controllable capacity arranged in a gas outlet in said reaction vessel for evacuation of gas therefrom, a first pressure sensor for sensing the gas pressure in said pulp shredding vessel, a second pressure sensor for sensing the gas pressure in said reaction vessel, and a regulation unit which in response to said first and second pressure sensors, respectively, regulates the capacity of said first and second fans, respectively.

2. A system for treatment of pulp, comprising:

a dewatering device for dewatering said pulp to a fiber concentration of at least 20%, a pulp shredding device for shredding said dewatered pulp, said pulp shredding device including a closed pulp shredding vessel, an outlet pipe from said pulp shredding vessel, and a transport means adapted to continuously transport said shredded pulp without compressing the pulp out of said pulp shredding vessel through said outlet pipe, so that said outlet pipe is kept filled with passing pulp, a reaction vessel for bleaching said shredded pulp through reaction with ozone gas, a conduit gas sealed from the surroundings and connecting said outlet pipe of said pulp shredding vessel gas-tightly to said reaction vessel, so that the interior of said outlet pipe directly communicates with the interior of said reaction vessel through the interior of said conduit, and a pressure regulation device for regulating the gas pressure in said pulp shredding vessel and the gas pressure in said reaction vessel so that ozone gas is prevented from leaking upstream through said outlet pipe, said pressure regulation device comprising fan means for evacuation of gas from said pulp shredding vessel and said reaction vessel, pressure sensor means for sensing the gas pressure in said pulp shredding vessel and said reaction vessel, and a regulation unit for regulating the capacity of said fan means in response to said pressure sensor means.

3. A system for treatment of pulp according to claim 1 or 2, wherein said pressure regulation device is adapted to maintain the gas pressure in said pulp shredding vessel higher than the gas pressure in said reaction vessel.

4. A system for treatment of pulp according to claim 3, wherein said transport means comprises a transport screw extending in said pulp shredding vessel and provided with at least one toothed transport thread for shredding the pulp.

5. A system for treatment of pulp according to claim 4, wherein said transport screw also extends in said outlet pipe of said pulp shredding vessel.

6. A system for treatment of pulp according to claim 1 or 2, wherein said pressure regulation device regulates the pressure difference between the gas pressure in said pulp shredding vessel and the gas pressure in said reaction vessel towards a predetermined value.

* * * * *